US012612800B2

(12) United States Patent
Clapper

(10) Patent No.: US 12,612,800 B2
(45) Date of Patent: Apr. 28, 2026

(54) LOCKABLE GROUND ANCHOR

(71) Applicant: Brian J. Clapper, Penobscot, ME (US)

(72) Inventor: Brian J. Clapper, Penobscot, ME (US)

( * ) Notice: Subject to any disclaimer, the term of this patent is extended or adjusted under 35 U.S.C. 154(b) by 277 days.

(21) Appl. No.: 18/368,089

(22) Filed: Sep. 14, 2023

(65) Prior Publication Data

US 2025/0092712 A1 Mar. 20, 2025

(51) Int. Cl.
*E04H 15/62* (2006.01)

(52) U.S. Cl.
CPC ..... *E04H 15/62* (2013.01)

(58) Field of Classification Search
CPC ..... E04H 15/62; E04H 12/2223
See application file for complete search history.

(56) References Cited

U.S. PATENT DOCUMENTS 1,562,343 A * 11/1925 La Bore ..... E04H 12/2223 52/165
3,293,809 A * 12/1966 Daline ..... E04H 17/22 52/157
3,688,454 A * 9/1972 Wolfcarius ..... G01C 15/04 52/103
5,516,237 A * 5/1996 Hebant ..... E02D 7/28 405/133
10,008,134 B2 * 6/2018 Pura ..... E04H 12/2223
2006/0051183 A1 * 3/2006 Powell ..... E04H 12/2223 411/386
2006/0086884 A1 * 4/2006 Santos ..... E04H 12/2223 248/530
2017/0247899 A1 * 8/2017 Faries ..... E04H 12/223

* cited by examiner

*Primary Examiner* — Noah Chandler Hawk
(74) *Attorney, Agent, or Firm* — Anthony D. Pellegrini

(57) ABSTRACT

The present invention a lockable ground anchor configured to be placed into the ground and secured thereto, having two cooperating components that are rotated into the ground in opposite directions and then secured to each other with a locking device, thereby preventing removal by requiring both components to be rotated in the same direction while secured together.

20 Claims, 8 Drawing Sheets

LOCKABLE GROUND ANCHOR

BACKGROUND OF THE INVENTION

Ground anchors, also known as earth anchors, are well known in the art. They are commonly used to temporarily secure structures or other items to the ground, such as tents or canopies or the like. Ground anchors are typically configured as a spiral that is twisted into the ground. They tend to have a length of at least 12 inches, though they may be longer or shorter. A typical ground anchor may be comprised of a coil attached to top securing element. These are known as coil-style or spiral-style ground anchors. Another configuration is a shaft attached to a top securing member, with a helical inclined plane wrapped about the shaft. These are known as auger-style or screw-style ground anchors. In both of these configurations, the ground anchor is placed vertically onto the ground and then rotated, so that the anchoring element twists into the ground. Once the ground anchor is sufficiently embedded in the ground, items (typically by using ropes or cords) may be attached to the top securing element. Thus, ground anchors have been proven to be simple devices to easily attach structures and other items to the ground.

While ground anchors work well to anchor items to the ground, they have the disadvantage of being just as easy to remove from the ground as they are to be placed into the ground. That is, one need only rotate the ground anchor in the opposite direction as it was rotated to embed it into the ground, and the ground anchor quickly is removed from the ground. This leaves anchored items susceptible to theft.

The present invention overcomes the above-described disadvantage of existing ground anchors by providing a lockable ground anchor configured to be placed into the ground and secured thereto with a locking device, such as a padlock. So configured, once locked the lockable ground anchor cannot be easily removed from the ground in the manner of existing ground anchors. This benefit is achieved by providing two cooperating components which are rotated into the ground in opposite directions and then secured to each other, thereby preventing removal by requiring both components to be rotated in the same direction while secured together.

What has been described demonstrates a need for an improved ground anchor that can be secured to the ground in a manner that does not permit easy removal.

It is therefore an object of the present invention to provide a ground anchor that can be secured to the ground in a manner that does not permit easy removal.

It is a further object of the present invention to provide a ground anchor that is comprised of two cooperating components that must individually be rotated into the ground in opposite directions.

It is yet a further object of the present invention to provide a ground anchor wherein the two cooperating components may be secured to each other once embedded into the ground, preventing simultaneous rotation of both in opposite directions.

It is yet a further object of the present invention to provide a ground anchor that is comprised of two cooperating components that can be locked together using a locking device, such as a padlock, once embedded into the ground.

Other objects of the present invention will be readily apparent from the description that follows.

SUMMARY OF THE INVENTION

The present invention is a lockable ground anchor that is comprised of two cooperating components that are individually rotated into the ground. One component is rotated in the clockwise direction to embed it into the ground while the other component is rotated in the counter-clockwise direction to embed it into the ground. One of the components is placed within the other component, such that the deployed lockable ground anchor has an outer anchor assembly and an inner anchor assembly. The outer anchor assembly is embedded into the ground first, and then the inner anchor assembly is positioned within the outer anchor assembly and then embedded into the ground. The two anchor assemblies are then locked together with a locking device, such as a padlock. Because the two anchor assemblies are locked together, any rotation of the lockable ground anchor necessarily rotates both anchor assemblies in the same direction. This results in one anchor assembly tending toward removal from the ground while the other anchor assembly tending towards further embedding into the ground; these two tendencies cancel each other out and the lockable ground anchor remains embedded in place. In order to remove the lockable ground anchor from the ground, the locking device that secures the two anchor assemblies to each other is removed, and then each of the anchor assemblies is individually rotated in opposite directions, allowing each to be removed from the ground.

The lockable ground anchor of the present invention may be configured as either a spiral-style ground anchor or an auger-style ground anchor. The spiral-style configuration provides an outer anchor assembly and an inner anchor assembly that are both comprised of a coiled anchor member, with the coiled anchor member of the inner anchor assembly being of a smaller diameter than that of the outer anchor assembly. The auger-style configuration provides an outer anchor assembly that comprises a hollow sleeve with a screw type inclined plane wrapped around the outer surface of the sleeve, while the inner anchor assembly comprises a shaft with a screw type inclined plane wrapped around the shaft, with the shaft of the inner anchor assembly being sized to fit within the sleeve of the outer anchor assembly.

It is to be understood that the foregoing and following description of the invention is intended to be illustrative and exemplary rather than restrictive of the invention as claimed. These and other aspects, advantages, and features of the invention will become apparent to those skilled in the art after review of the entire specification, accompanying figures, and claims incorporated herein.

DETAILED DESCRIPTION OF THE INVENTION

Figure 1A:
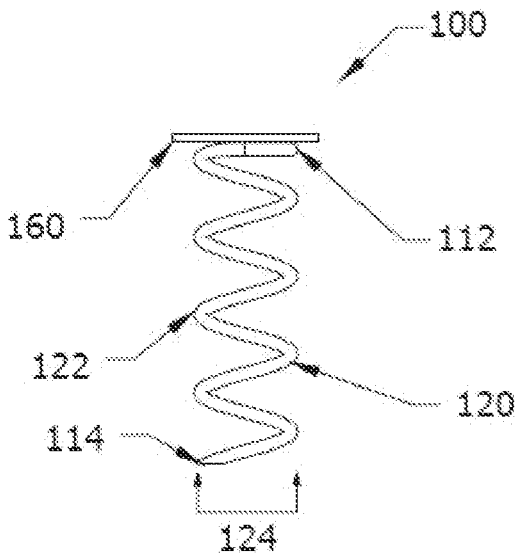
FIG. 1A is a side view of the outer anchor assembly of one embodiment of the present invention.
Figure 1B:
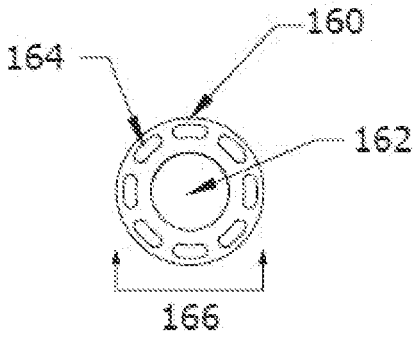
FIG. 1B is a top view of the outer lock plate of the embodiment of the present invention as shown in FIG. 1A.
Figure 2A:
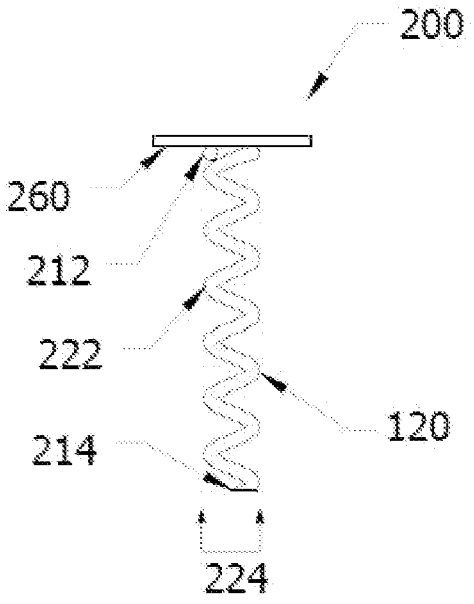
FIG. 2A is a side view of the inner anchor assembly of the embodiment of the present invention as shown in FIG. 1A.
Figure 2B:
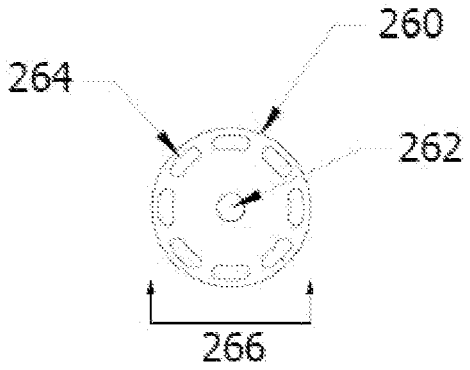
FIG. 2B is a top view of the inner lock plate of the embodiment of the present invention as shown in FIG. 1A.
Figure 3:
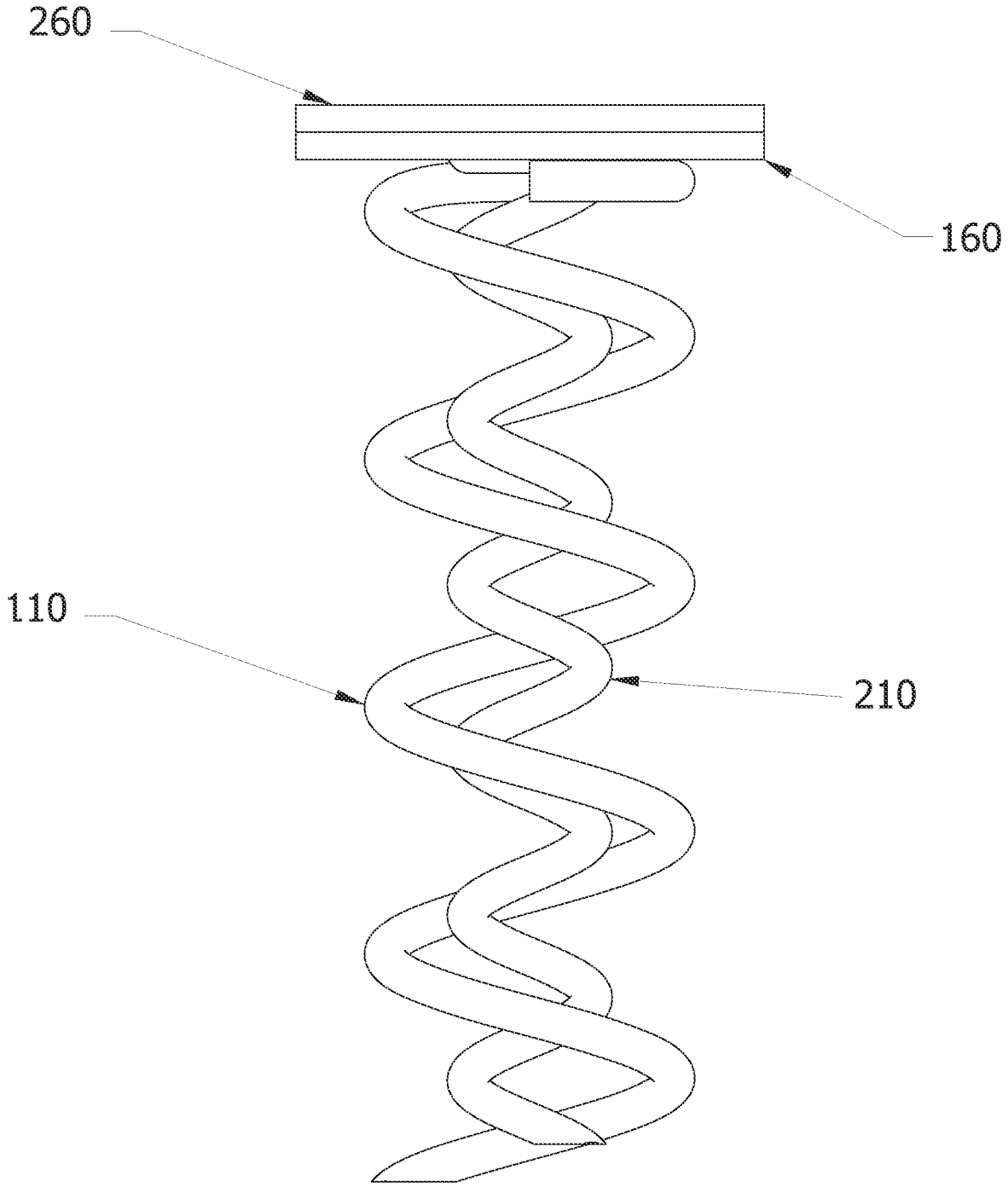
FIG. 3 is a side view of the outer anchor assembly cooperatively engaged with the inner anchor assembly of the embodiment of the present invention as shown in FIG. 1A.
Figure 4B:
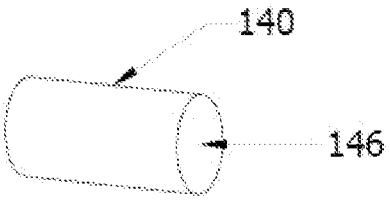
FIG. 4B is a perspective view of the sleeve of the outer anchor screw member of the embodiment of the present invention as shown in FIG. 4A.
Figure 4A:
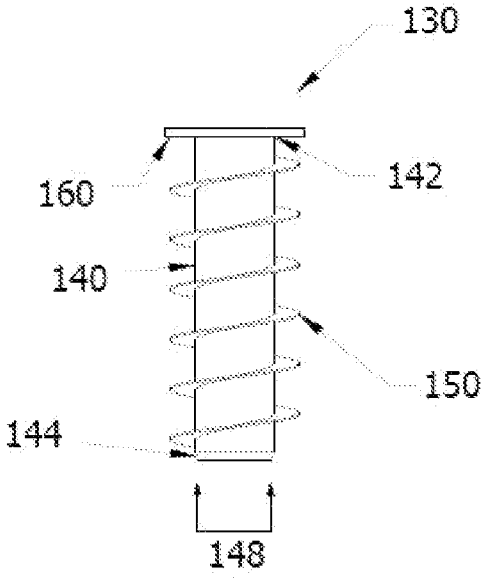
FIG. 4A is a side view of the outer anchor screw member of another embodiment of the present invention.
Figure 5:
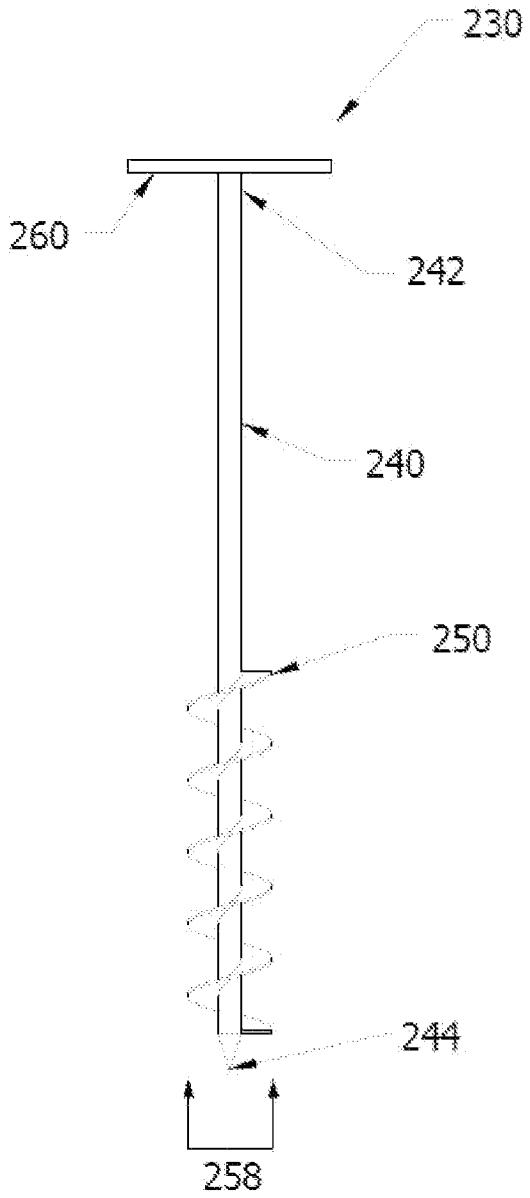
FIG. 5 is a side view of the inner anchor screw member of the embodiment of the present invention as shown in FIG. 4A.
Figure 6:
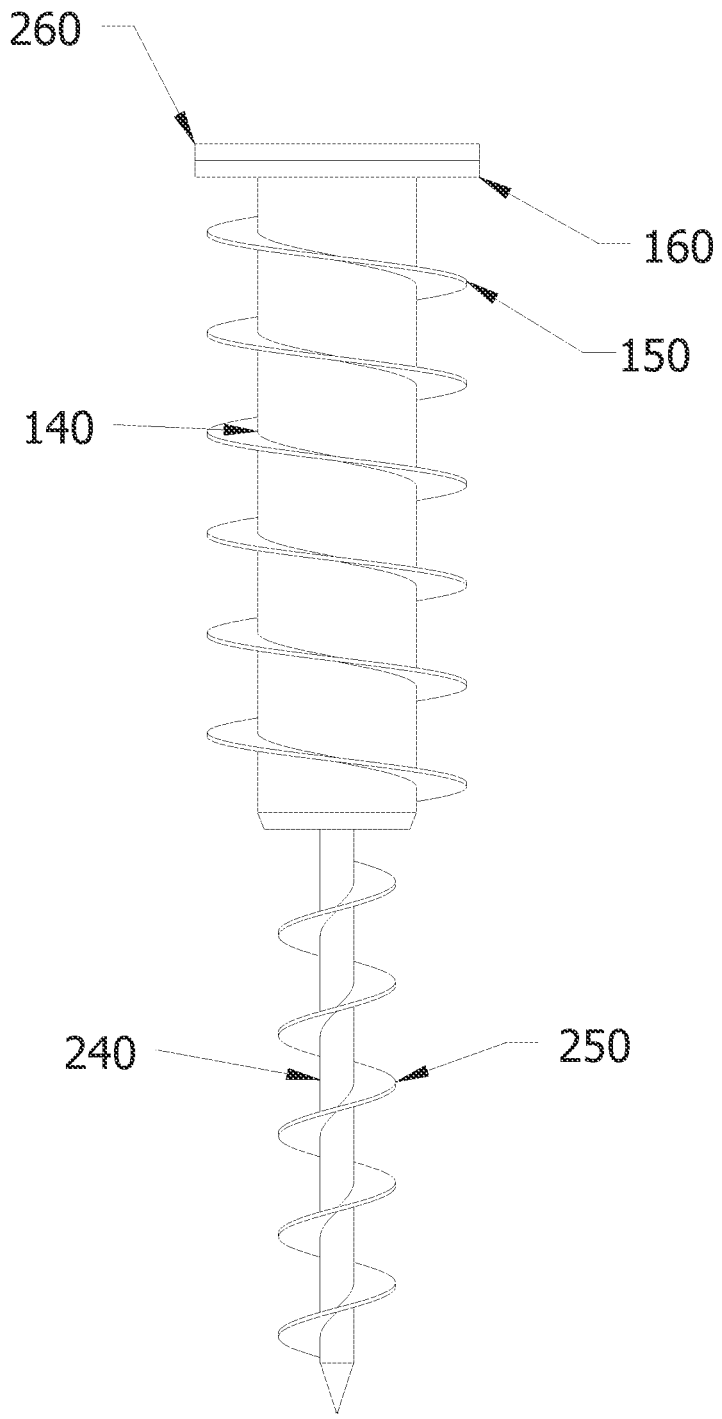
FIG. 6 is a side view of the outer anchor screw member cooperatively engaged with the inner anchor screw member of the embodiment of the present invention as shown in FIG. 4A.
Figure 7A:
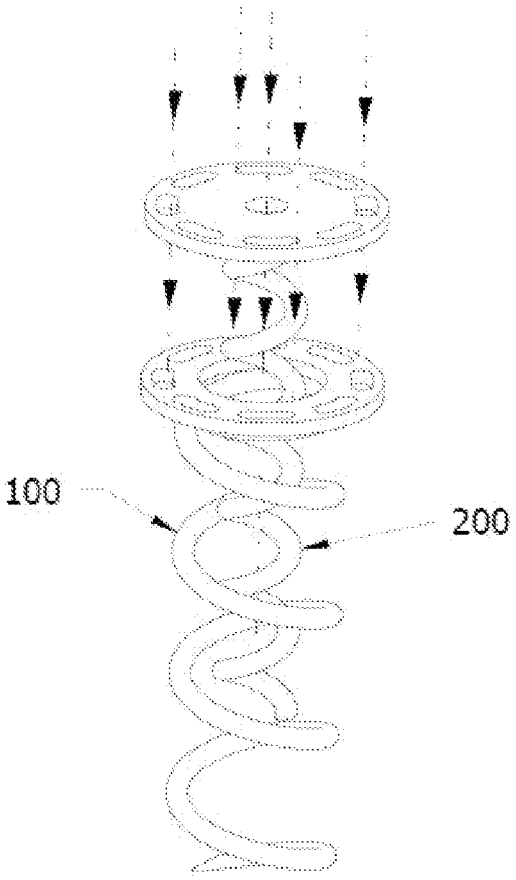
FIG. 7A is a perspective view of the inner anchor assembly being engaged with the outer anchor assembly of the embodiment of the present invention as shown in FIG. 1A.
Figure 7B:
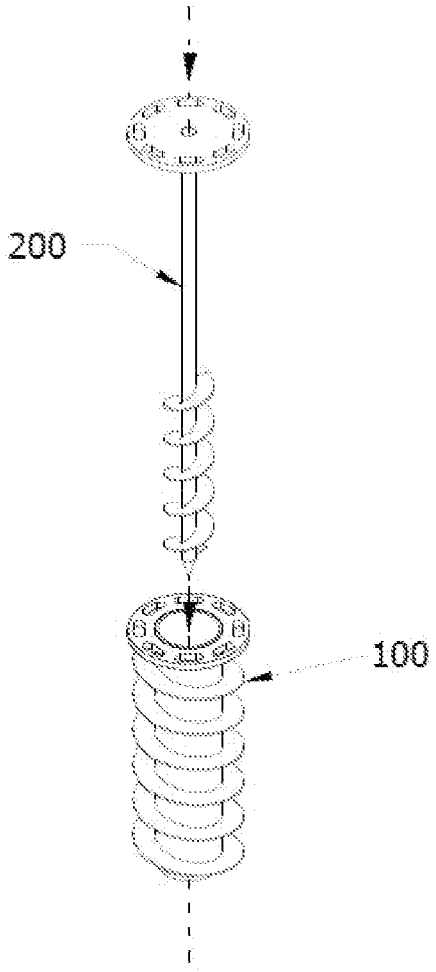
FIG. 7B is a perspective view of the inner anchor assembly being engaged with the outer anchor assembly of the embodiment of the present invention as shown in FIG. 4A.
Figure 8A:
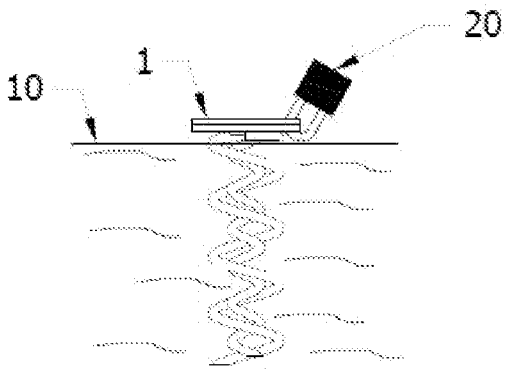
FIG. 8A is a side view of the lockable ground anchor of the embodiment of the present invention as shown in FIG. 1A embedded in the ground in locked mode.
Figure 8B:
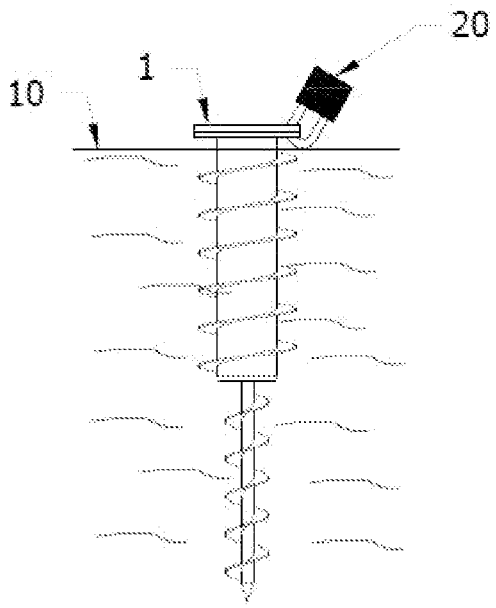
FIG. 8B is a side view of the lockable ground anchor of the embodiment of the present invention as shown in FIG. 4A embedded in the ground in locked mode.

In one aspect of the present invention a lockable ground anchor 1 is disclosed. The lockable ground anchor 1 is configured to be placed into the ground 10 and secured thereto. The lockable ground anchor 1 comprises two cooperating components: an outer anchor assembly 100 and an inner anchor assembly 200. By utilizing these two components as described below, and then applying a locking device 20 thereto, the lockable ground anchor 1 can be embedded in the ground 10 in a manner that makes it very difficult to remove.

The outer anchor assembly 100 of the lockable ground anchor 1 is comprised of an outer anchor member 110 and an outer lock plate 160. The outer anchor member 110 is configured to be placed into the ground 10 and has a proximate end 112 and a distal end 114. The proximate end 112 of the outer anchor member 110 is fixedly attached to the outer lock plate 160 such that the outer anchor member 110 is oriented substantially perpendicular to the outer lock plate 160. Similarly, the inner anchor assembly 200 of the lockable ground anchor 1 is comprised of an inner anchor member 210 and an inner lock plate 260. The inner anchor member 210 is configured to be placed into the ground 10 and has a proximate end 212 and a distal end 214. The proximate end 212 of the inner anchor member 210 is fixedly attached to the inner lock plate 260 such that the inner anchor member 210 is oriented substantially perpendicular to the inner lock plate 260.

The outer anchor assembly 100 is placed into the ground 10 by placing the distal end 114 of the outer anchor member 110 of the outer anchor assembly 100 into the ground 10 and rotating the outer anchor assembly 100 in a first direction. The first direction may be either clockwise or counterclockwise, depending on the specific configuration of the outer anchor member 110. The inner anchor assembly 200 is placed into the ground 10 by placing the distal end 214 of the inner anchor member 210 of the inner anchor assembly 200 into the ground 10 and rotating the inner anchor assembly 200 in a second direction, which is opposite the first direction. To facilitate insertion of the outer anchor assembly 100 and the inner anchor assembly 200 into the ground, the distal end 114 of the outer anchor member 110 may be pointed and the distal end 214 of the inner anchor member 210 may be pointed.

The outer anchor member 110 may be the same length as the inner anchor member 210. In a preferred embodiment, the inner anchor member 210 is longer than the outer anchor member 110.

The outer lock plate 160 may have various configurations, but in the preferred embodiments it is a rigid plate. It may be constructed out of steel, other metals, composite materials, plastics, wood, or any other material having the properties of high strength and rigidity. The outer lock plate 160 may have any number of shapes, though in the preferred embodiment it is circular. In all configurations, the outer lock plate 160 has a central aperture 162 and one or more perimeter apertures 164. The central aperture 162 should be circular and must pass completely through the thickness of the outer lock plate 160. If there is more than one perimeter aperture 164 they may be regularly spaced apart around the perimeter of the outer lock plate 160, or they may be irregularly spaced. Each perimeter aperture 164 must pass completely through the thickness of the outer lock plate 160, and each perimeter aperture 164 must be large enough to accommodate a locking device 20. However, if there is more than one perimeter aperture 164 they need not be all dimensioned the same, though in the preferred embodiment all of the perimeter apertures 164 are dimensioned the same. In the most preferred embodiment, the one or more perimeter apertures 164 are elongate, though in other embodiments they may be circular or have other shapes. Attached to the outer lock plate 160 may be an attachment component, such as a fixed or pivoting ring or hook, or a fixed loop, or a pivoting loop, or the like, providing a place to attach a cord or a rope. Alternatively, the perimeter apertures 164 may themselves be used as attachment points, by threading a cord or rope through one or more perimeter apertures 164.

The inner lock plate 260 is configured substantially the same as the outer lock plate 160, as described above, and may be constructed of the same material. The diameter 266 of the inner lock plate 260 should be substantially the same as the diameter 166 of the outer lock plate 160. In all configurations, the inner lock plate 260 has one or more perimeter apertures 264. Each perimeter aperture 264 must pass completely through the thickness of the inner lock plate 260. There is a central area 262 of the inner lock plate 260 that may or may not contain an aperture. The perimeter apertures 264 of the inner lock plate 260 may be disposed around the perimeter of the inner lock plate 260 in the same manner as the perimeter apertures 164 of the outer lock plate 160, and may have the same shapes. The inner lock plate 260 may have the same number of perimeter apertures 264 as the outer lock plate 160, or a different number. Each perimeter aperture 264 must be large enough to accommodate a locking device 20. Attached to the inner lock plate 260 may be an attachment component, as described above.

In one embodiment of the present invention, the outer anchor member 110 is comprised of an outer anchor coil member 120. The outer anchor coil member 120 is a rigid coil comprised of a plurality of individual coils 122 that are each coiled in a first direction. The first direction may be either clockwise (where the coils 122 are considered as having a "right handed" twist) or counter clockwise (where the coils 122 are considered as having a "left handed" twist). The outer anchor coil member 120 may be constructed out of steel, other metals, composite materials, plastics, or any other material having the properties of high strength and rigidity. The proximate end 112 of the outer anchor member 110 is fixedly attached to the outer lock plate 160 at a location on the outer lock plate 160 proximate to the central aperture 162 of the outer lock plate 160. So positioned, each individual coil 122 of the outer anchor coil member 120 is aligned with the central aperture 162 of the outer lock plate 160.

In this same embodiment, the inner anchor member 210 is comprised of an inner anchor coil member 220. The inner anchor coil member 220 is a rigid coil comprised of a plurality of individual coils 222 that are each coiled in a second direction. The second direction is the opposite of the first direction. The cross-sectional diameter 224 of the inner anchor coil member 210 is less than the cross-sectional diameter 124 of the outer anchor coil member 120. It is also less than the inside diameter of the central aperture 162 of the outer lock plate 160. The inner anchor coil member 220 may be constructed out of the same materials as the outer anchor coil member 120. The proximate end 212 of the inner anchor member 210 is fixedly attached to the inner lock plate 260 at a location on the inner lock plate 260 proximate to the central area 262 of the inner lock plate 260. So positioned, each individual coil 222 of the inner anchor coil member 220 is aligned with the central area 262 of the inner lock plate 260.

In this embodiment, the lockable ground anchor 1 has a locked mode and an unlocked mode. The lockable ground anchor 1 is placed in the locked mode by performing the following steps: first, the lockable ground anchor 1 is placed into the ground 10 by placing the distal end 114 of the outer anchor member 110 into the ground 10 and then rotating the outer anchor coil member 120 in the first direction until at least a plurality of individual coils 122 of the outer anchor coil member 120 located closest to the distal end 114 of the outer anchor member 110 are embedded in the ground 10. Preferably, all or nearly all of the individual coils 112 of the outer anchor coil member 110 should be embedded in the ground 10, resulting in the outer lock plate 160 being flush or nearly flush to the ground 10. The next step is to place the distal end 214 of the inner anchor member 210 through the central aperture 162 of the outer lock plate 160 and then into the ground 10, and then rotating the inner anchor coil member 220 in the second direction until at least a plurality of individual coils 222 of the inner anchor coil member 220 located closest to the distal end 214 of the inner anchor member 210 are embedded in the ground 10. Preferably, all or nearly all of the individual coils 212 of the inner anchor coil member 210 should be embedded in the ground 10, resulting in the inner lock plate 260 being flush or nearly flush to the outer lock plate 160. The next step is to align one of the perimeter apertures 264 of the inner lock plate 260 with one of the perimeter apertures 164 of the outer lock plate 160. The final step is to place a locking device 20 through the respective aligned perimeter apertures 164,264 of the outer lock plate 160 and the inner lock plate 260 and locking the locking device 20. Typically, the locking device 20 will be a padlock.

Once the lockable ground anchor 1 is in locked mode, it is very difficult to remove from the ground 1. Because the outer anchor member 110 and the inner anchor member 210 are configured with oppositely oriented anchor coil members 120, 220, they must be rotated in opposite directions in order to extract them from the ground 10; however, because the outer anchor member 110 and the inner anchor member 210 are secured together by the locking device 20, they can only be rotated in the same direction. In other words, while rotation of the lockable ground anchor 1 in the first direction would tend to cause the inner anchor coil member 220 to come out of the ground 10, that same direction of rotation would tend to cause the outer anchor coil member 120 to embed further into the ground 10, and while rotation of the lockable ground anchor 1 in the second direction would tend to cause the outer anchor coil member 120 to come out of the ground 10, that same direction of rotation would tend to cause the inner anchor coil member 220 to embed further into the ground 10.

In order to place the lockable ground anchor 1 in the unlocked mode, one simply unlocks the locking device 20 and removes the locking device 20 from the respective aligned perimeter apertures 164,264 of the outer lock plate 160 and the inner lock plate 260. Now the outer anchor coil member 120 and the inner anchor coil member 220 can be rotated in opposite directions so that they can be removed from the ground 10.

In another embodiment of the present invention, the outer anchor member 110 is an outer anchor screw member 130. The outer anchor screw member 130 is comprised of a hollow cylindrical sleeve 140 and a helical inclined plane 150. The sleeve 140 has a proximate end 142 and a distal end 144. The helical inclined plane 150 of the outer anchor screw member 130 is located on the outer surface of the sleeve 140 and wraps around the sleeve 140, with the helical inclined plane 150 of the outer anchor screw member 130 being angled in a first direction relative to the sleeve 140. The first direction may be either clockwise (where the helical inclined plane 150 is considered as having a "right handed" twist) or counter clockwise (where the helical inclined plane 150 is considered as having a "left handed" twist). The sleeve 140 and helical inclined plane 150 may be constructed out of steel, other metals, composite materials, plastics, or any other material having the properties of high strength and rigidity. The proximate end 142 of the sleeve 140 of the outer anchor screw member 130 is fixedly attached to the outer lock plate 160 at a location on the outer lock plate 160 around the central aperture 162 of the outer lock plate 160. So positioned, the interior space 146 of the sleeve 140 of the outer anchor screw member 130 is aligned with the central aperture 162 of the outer lock plate 160.

In this same embodiment, the inner anchor member 210 is an inner anchor screw member 230. The inner anchor screw member 230 is comprised of a shaft 240 and a helical inclined plane 250. The shaft 240 has a proximate end 242 and a distal end 244. The helical inclined plane 250 of the inner anchor screw member 230 is located on the shaft 240 proximate to the distal end 244 of the shaft 240 and wraps around the shaft 240, with the helical inclined plane 250 of the inner anchor screw member 230 being angled in a second direction relative to the shaft 240, opposite the first direction. The helical inclined plane 250 of the inner anchor screw member 230 may be wrapped only partially around the shaft 240 of the inner anchor screw member 230, or it may be wrapped along the entire length of the shaft 240. The helical inclined plane 250 of the inner anchor screw member 230 has an outside diameter 248 less than the inside diameter 148 of the sleeve 140 of the outer anchor screw member 130, and less than the inside diameter of the central aperture 162 of the outer lock plate 160. The inner anchor screw member 120 may be constructed out of the same materials as the outer anchor screw member 130. The proximate end 242 of the shaft 240 of the inner anchor screw member 230 is fixedly attached to the inner lock plate 260 at the central area 262 of the inner lock plate 260.

In this embodiment, the lockable ground anchor 1 has a locked mode and an unlocked mode. The lockable ground anchor 1 is placed in the locked mode by performing the following steps: first, the lockable ground anchor 1 is placed into the ground 10 by placing the distal end 114 of the outer anchor member 110 into the ground 10 and then rotating the outer anchor screw member 130 in the first direction until at least a portion of the helical inclined plane 150 of the outer anchor screw member 130 located closest to the distal end 142 of the sleeve 140 of the outer anchor screw member 130 is embedded in the ground 10. Preferably, all or nearly all of the helical inclined plane 150 should be embedded in the ground 10, resulting in the outer lock plate 160 being flush or nearly flush to the ground 10. The next step is to place the distal end 242 of the shaft 240 of the inner anchor screw member 230 through the central aperture 162 of the outer lock plate 160 and into the interior space 146 of the sleeve 140 of the outer anchor screw member 130 and then into the ground 10, and then rotating the inner anchor assembly 200 in the second direction until at least a portion of the helical inclined plane 250 of the inner anchor screw member 230 located closest to the distal end 242 of the shaft 240 of the inner anchor screw member 230 is embedded in the ground 10. Preferably, all or nearly all of the helical inclined plane 250 of the inner anchor screw member 230 should be embedded in the ground 10, resulting in the inner lock plate 260 being flush or nearly flush to the outer lock plate 160. The next step is to align one of the perimeter apertures 264 of the inner lock plate 260 with one of the perimeter apertures 164 of the outer lock plate 160. The final step is to place a locking device 20 through the respective aligned perimeter apertures 164,264 of the outer lock plate 160 and the inner lock plate 260 and locking the locking device 20. Again, the locking device 20 may be a padlock.

Once the lockable ground anchor 1 is in locked mode, it is very difficult to remove from the ground 1, for the same reasons as described with regard to the previously described embodiment of the present invention: because the outer anchor member 110 and the inner anchor member 210 are configured with oppositely oriented anchor screw members 130, 230, they must be rotated in opposite directions in order to extract them from the ground 10; however, because the outer anchor member 110 and the inner anchor member 210 are secured together by the locking device 20, they can only be rotated in the same direction.

In order to place the lockable ground anchor 1 in the unlocked mode, one simply unlocks the locking device 20 and removes the locking device 20 from the respective aligned perimeter apertures 164,264 of the outer lock plate 160 and the inner lock plate 260. Now the outer anchor screw member 130 and the inner anchor screw member 230 can be rotated in opposite directions so that they can be removed from the ground 10.

Modifications and variations can be made to the disclosed embodiments of the present invention without departing from the subject or spirit of the invention.

I claim:

1. A lockable ground anchor configured to be placed into the ground, said lockable ground anchor comprising an outer anchor assembly and an inner anchor assembly, wherein the outer anchor assembly is comprised of an outer anchor member and an outer lock plate, wherein the outer anchor member has a proximate end and a distal end and the proximate end of the outer anchor member is fixedly attached to the outer lock plate such that the outer anchor member is oriented substantially perpendicular to the outer lock plate; and the inner anchor assembly is comprised of an inner anchor member and an inner lock plate, wherein the inner anchor member has a proximate end and a distal end and the proximate end of the inner anchor member is fixedly attached to the inner lock plate such that the inner anchor member is oriented substantially perpendicular to the inner lock plate;

whereby, the outer anchor assembly of the lockable ground anchor is configured to be placed into the ground by placing the distal end of the outer anchor member of the outer anchor assembly into the ground and rotating the outer anchor assembly in a first direction, and the inner anchor assembly of the lockable ground anchor is configured to be placed into the ground by placing the distal end of the inner anchor member of the inner anchor assembly into the ground and rotating the inner anchor assembly in a second direction opposite the first direction.

2. The lockable ground anchor of claim 1 wherein the distal end of the outer anchor member is pointed.

3. The lockable ground anchor of claim 1 wherein the distal end of the inner anchor member is pointed.

4. The lockable ground anchor of claim 1 wherein the outer anchor member further comprises a length and the inner anchor member further comprises a length, with the length of the inner anchor member being longer than the length of the outer anchor member.

5. A lockable ground anchor configured to be placed into the ground, said lockable ground anchor comprising an outer anchor assembly and an inner anchor assembly, wherein the outer anchor assembly is comprised of an outer anchor member and an outer lock plate, wherein the outer anchor member has a proximate end and a distal end and the proximate end of the outer anchor member is fixedly attached to the outer lock plate such that the outer anchor member is oriented substantially perpendicular to the outer lock plate; and the inner anchor assembly is comprised of an inner anchor member and an inner lock plate, wherein the inner anchor member has a proximate end and a distal end and the proximate end of the inner anchor member is fixedly attached to the inner lock plate such that the inner anchor member is oriented substantially perpendicular to the inner lock plate;

whereby, the outer anchor assembly of the lockable ground anchor is configured to be placed into the ground by placing the distal end of the outer anchor member of the outer anchor assembly into the ground and rotating the outer anchor assembly in a first direction, and the inner anchor assembly of the lockable ground anchor is configured to be placed into the ground by placing the distal end of the inner anchor member of the inner anchor assembly into the ground and rotating the inner anchor assembly in a second direction opposite the first direction;

wherein the outer lock plate is a rigid, planar circular plate having a central aperture, one or more perimeter apertures, and a diameter; and the inner lock plate is a rigid, planar circular plate having a central area, one or more perimeter apertures, and a diameter, where the diameter of the inner lock plate is substantially the same as the diameter of the outer lock plate.

6. The lockable ground anchor of claim 5 wherein the outer lock plate has a plurality of perimeter apertures.

7. The lockable ground anchor of claim 5 wherein the inner lock plate has a plurality of perimeter apertures.

8. The lockable ground anchor of claim 7 wherein the inner lock plate has a like number of perimeter apertures as the outer lock plate.

9. The lockable ground anchor of claim 5 wherein the outer lock plate further comprises an attachment component, wherein the attachment component is fixedly attached to the outer lock plate.

10. The lockable ground anchor of claim 5 wherein the outer lock plate further comprises an attachment component, wherein the attachment component is hingedly attached to the outer lock plate.

11. The lockable ground anchor of claim 5 wherein the outer lock plate further comprises an attachment component, said attachment component being one of the group of a ring, a hook, and a loop, wherein the attachment component is attached to the outer lock plate.

12. The lockable ground anchor of claim 5 wherein the inner lock plate further comprises an attachment component, wherein the attachment component is fixedly attached to the inner lock plate.

13. The lockable ground anchor of claim 5 wherein the inner lock plate further comprises an attachment component, wherein the attachment component is hingedly attached to the inner lock plate.

14. The lockable ground anchor of claim 5 wherein the inner lock plate further comprises an attachment component, said attachment component being one of the group of a ring, a hook, and a loop, wherein the attachment component is attached to the inner lock plate.

15. The lockable ground anchor of claim 5 wherein the outer anchor member is comprised of an outer anchor coil member, with the outer anchor coil member being a rigid coil having a cross-sectional diameter, with the outer anchor coil member being comprised of a plurality of individual coils that are each coiled in the first direction, wherein the proximate end of the outer anchor member is fixedly attached to the outer lock plate at a location on the outer lock plate proximate to the central aperture of the outer lock plate such that each individual coil of the outer anchor coil member is aligned with the central aperture of the outer lock plate; and the inner anchor member is comprised of an inner anchor coil member, with the inner anchor coil member being a rigid coil having a cross-sectional diameter, where the cross-sectional diameter of the inner anchor coil member is less than the cross-sectional diameter of the outer anchor coil member, with the inner anchor coil member being comprised of a plurality of individual coils that are each coiled in the second direction, wherein the proximate end of the inner anchor member is fixedly attached to the inner lock plate at a location on the inner lock plate proximate to the central area of the inner lock plate such that each individual coil of the inner anchor coil member is aligned with the central area of the inner lock plate.

16. The lockable ground anchor of claim 15 further having a locked mode and an unlocked mode, wherein the lockable ground anchor is placed in the locked mode by placing the lockable ground anchor into the ground by first placing the distal end of the outer anchor member into the ground and rotating the outer anchor coil member in the first direction until at least a plurality of individual coils of the outer anchor coil member located closest to the distal end of the outer anchor member are embedded in the ground, then by placing the distal end of the inner anchor member through the central aperture of the outer lock plate and into the ground and rotating the inner anchor coil member in the second direction until at least a plurality of individual coils of the inner anchor coil member located closest to the distal end of the inner anchor member are embedded in the ground and the inner lock plate comes into close proximity to the outer lock plate, then aligning one of the perimeter apertures of the inner lock plate with one of the perimeter apertures of the outer lock plate, and then placing a locking device through the respective aligned perimeter apertures of the outer lock plate and the inner lock plate and locking the locking device; and the lockable ground anchor is placed in the unlocked mode by unlocking the locking device and removing the locking device from the respective aligned perimeter apertures of the outer lock plate and the inner lock plate.

17. The lockable ground anchor of claim 16 wherein the locking device is a padlock.

18. The lockable ground anchor of claim 5 wherein the outer anchor member is comprised of an outer anchor screw member, with the outer anchor screw member comprising a hollow cylindrical sleeve and a helical inclined plane, with the sleeve having a proximate end, a distal end, an interior space, and an inside diameter, and the helical inclined plane of the outer anchor screw member being located on an outer surface of the sleeve and wraps around the sleeve, with the helical inclined plane of the outer anchor screw member being angled in a first direction relative to the sleeve, wherein the proximate end of the sleeve of the outer anchor screw member is fixedly attached to the outer lock plate at a location on the outer lock plate around the central aperture of the outer lock plate such that the interior space of the sleeve of the outer anchor screw member is aligned with the central aperture of the outer lock plate; and the inner anchor member is comprised of an inner anchor screw member, with the inner anchor screw member comprising a shaft and a helical inclined plane, with the shaft having a proximate end and a distal end, and the helical inclined plane of the inner anchor screw member being located on the shaft proximate to the distal end of the shaft and wraps around the shaft, with the helical inclined plane of the inner anchor screw member being angled in a second direction relative to the shaft opposite the first direction, where the helical inclined plane of the inner anchor screw member has an outside diameter less than the inside diameter of the sleeve of the outer anchor screw member;

wherein the proximate end of the shaft of the inner anchor screw member is fixedly attached to the inner lock plate at the central area of the inner lock plate.

19. The lockable ground anchor of claim 18 further having a locked mode and an unlocked mode, wherein the lockable ground anchor is placed in the locked mode by placing the lockable ground anchor into the ground by first placing the distal end of the outer anchor member into the ground and rotating the outer anchor assembly in the first direction until at least a portion of the helical inclined plane of the outer anchor screw member located closest to the distal end of the sleeve of the outer anchor screw member is embedded in the ground, then by placing the distal end of the shaft of the inner anchor screw member through the central aperture of the outer lock plate and into the interior space of the sleeve of the outer anchor screw member and into the ground and rotating the inner anchor assembly in the second direction until at least a plurality of at least a portion of the helical inclined plane of the inner anchor screw member located closest to the distal end of the shaft of the inner anchor screw member is embedded in the ground and the inner lock plate comes into close proximity to the outer lock plate, then aligning one of the perimeter apertures of the inner lock plate with one of the perimeter apertures of the outer lock plate, and then placing a locking device through the respective aligned perimeter apertures of the outer lock plate and the inner lock plate and locking the locking device; and the lockable ground anchor is placed in the unlocked mode by unlocking the locking device and removing the locking device from the respective aligned perimeter apertures of the outer lock plate and the inner lock plate.

20. The lockable ground anchor of claim 19 wherein the locking device is a padlock.

* * * * *